US005393257A

United States Patent [19]

Spector

[11] Patent Number: 5,393,257

[45] Date of Patent: Feb. 28, 1995

[54] TOY FIGURE AND HEADSET ASSEMBLY

[76] Inventor: Donald Spector, 380 Mountain Rd., Union City, N.J. 07080

[21] Appl. No.: 231,663

[22] Filed: Apr. 25, 1994

Related U.S. Application Data

[63] Continuation-in-part of Ser. No. 205,564, Mar. 4, 1994.

[51] Int. Cl.[6] ..... A63H 3/28

[52] U.S. Cl. ..... 446/27; 446/73; 446/81; 446/302

[58] Field of Search ..... 446/26–28, 446/71, 72, 73, 81, 297, 299, 390, 302; 2/DIG. 11, 171; 381/25

[56] References Cited

U.S. PATENT DOCUMENTS

| | | | |
|---|---|---|---|
| D. 162,159 | 2/1951 | Harfenist | 2/171 |
| 1,927,453 | 9/1933 | Hill | 446/72 |
| 4,280,292 | 7/1981 | Hills | 446/28 |
| 4,521,205 | 6/1985 | Spector | 446/299 |
| 4,764,962 | 8/1988 | Ekman et al. | 381/25 |
| 4,828,527 | 5/1989 | Spector | 446/302 |
| 4,878,871 | 11/1989 | Noto | 446/81 |
| 5,059,149 | 10/1991 | Stone | 446/71 |
| 5,285,530 | 2/1994 | Nardone | 2/DIG. 11 |

FOREIGN PATENT DOCUMENTS

| | | | |
|---|---|---|---|
| 1248355 | 1/1989 | Canada | 446/297 |
| 646668 | 11/1950 | United Kingdom | 446/297 |

*Primary Examiner*—Robert A. Hafer
*Assistant Examiner*—Jeffrey D. Carlson
*Attorney, Agent, or Firm*—Michael Ebert

[57] ABSTRACT

A stuffed toy figure having a humanoid or animal-like form, such as that of a monkey, the figure including a stuffed torso and a pair of stuffed arms extending therefrom and ending in hands. Housed in the torso is a portable audio tape cassette player. The figure is carried by a child wearing an earphone headset having left and right earphones, these being connected by respective cables which run through the hands and arms to the output of the player housed in the torso. The cables leading to the earphones serve to dangle the figure from the headset and so as to raise the arms to place the hands on the shoulders of a child listening to the recording reproduced by the cassette player.

8 Claims, 1 Drawing Sheet

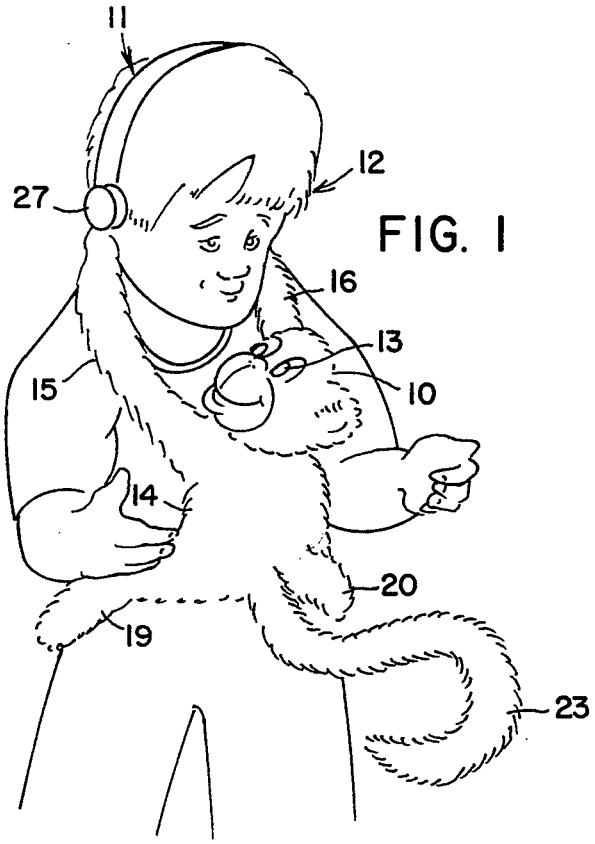
FIG. 1
FIG. 3
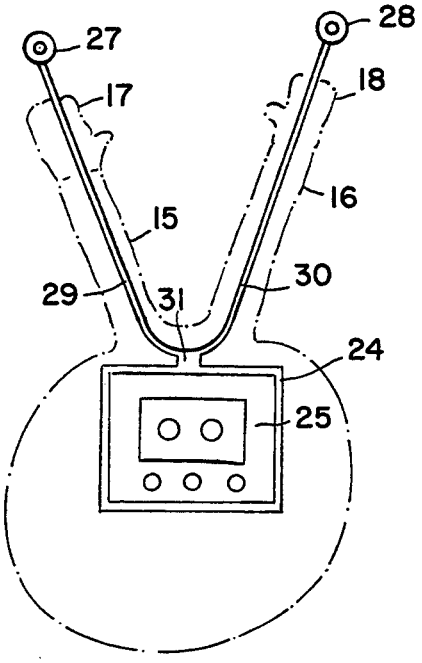
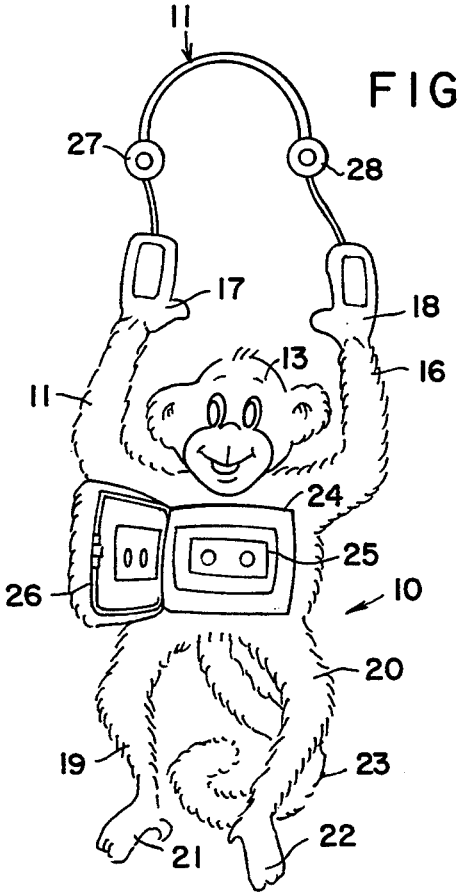
FIG. 2
FIG. 4
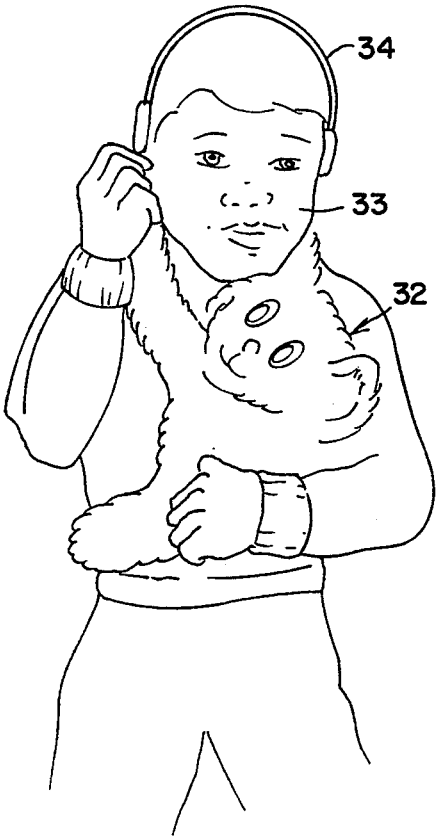

TOY FIGURE AND HEADSET ASSEMBLY

RELATED APPLICATION

This application is a continuation-in-part of my co-pending application "Interactive Stuffed Toy Figure" Ser. No. 08/205,564, filed Mar. 4, 1994, the enclosed disclosure of which is incorporated herein by reference.

BACKGROUND OF THE INVENTION

1. Field of Invention

This invention relates generally to stuffed toy figures having a humanoid or animal-like form, and more particularly to an assembly of a figure including this type in whose torso is housed a magnetic tape audio cassette player which cooperates with an earphone headset worn by the child carrying the figure so that the child then listens to a reproduced recording supplied to the earphones by the figure dangling from the headset.

2. Status of Prior Art

The 1991 patent to Stone U.S. Pat. No. 5,059,149 discloses a stuffed toy figure such as a Teddy Bear provided with compartments for storing a children's book, drawing paper and crayons, and an audio cassette player, these constituting audio and visual educational material. When this material is withdrawn from the compartments and put to educational use by a child, the Teddy Bear in no way participates in this activity, nor does it interact with the child who plays with this soft figure.

In my above-identified co-pending patent application, there is disclosed a stuffed toy figure whose animal-like or humanoid form resembles that of an established character such as MICKEY MOUSE or BIG BIRD. This figure includes a compartment in its torso which accommodates a magnetic tape audio cassette whose recording is related to the character. When this cassette is removed from the figure and inserted in a nearby cassette player, the child holding the figure then hears the reproduced recording which simulates the voice of the character and seemingly speaks to the child, inducing the child to respond to questions and to manipulate the figure in various ways. Thus the child interacts with the particular character represented by the figure he is holding.

In the Stone arrangement, the stuffed figure serves only as a storage compartment for a magnetic tape cassette player, and if the child wishes to put this player to use, he must remove it from the figure, place an audio tape cassette therein, and listen to whatever is recorded on the tape. The operation of the cassette player is, therefore, in no way related to the handling of the figure by the child, whereas in my co-pending application, it is only the audio magnetic tape cassette which is housed in the figure and the player therefor is extrinsic to the figure.

SUMMARY OF INVENTION

In view of the foregoing, the main object of this invention is to provide an assembly of a stuffed toy figure having a humanoid or animal-like form, such as that of a monkey, in whose torso is housed a magnetic tape audio cassette player which cooperates with an earphone headset worn by a child carrying the figure so that the child then listens to a reproduced recording supplied by the figure to the earphones of the headset.

More particularly an object of this invention is to provide an assembly of the above type in which the cables which connect the earphones of the headset to the output of the cassette player housed in the torso run through the respective stuffed arms and hands extending from the torso, so that the figure dangles from the headset.

A significant feature of the invention is that the cables, dangling the figure from the headset, act to raise its arms so that the hands then rest on the shoulders of the child carrying the figure. Also, the stuffed legs of the figure which extend from the torso then straddle the waist of the child wearing the headset so that the figure appears to be embracing the child.

Also an object of this invention is to provide an assembly of the above type which makes use of a standard earphone headset and a standard cassette player, and can be mass produced at relatively low cost.

Briefly stated, these objects are attained by a stuffed toy figure having a humanoid or animal-like form, such as that of a monkey, the figure including a stuffed torso and a pair of stuffed arms extending therefrom ending in hands. Housed in the torso is a portable audio tape cassette player. The figure is carried by a child wearing an earphone headset having left and right earphones, these being connected by respective cables which run through the hands and arms to the output of the player housed in the torso. The cables leading to the earphones serve to dangle the figure from the headset and to raise the arms so as to place the hands on the shoulders of the child listening to a recording reproduced by the cassette player.

BRIEF DESCRIPTION OF DRAWINGS

For a better understanding of the invention as well as other objects and features thereof, reference is made to the following detailed description to be read in conjunction with the accompanying drawings wherein:

FIG. 1 illustrates a preferred embodiment of an assembly in accordance with the invention constituted by a stuffed toy figure carried by a child and an earphone headset worn by the child;

FIG. 2 is a front view of the figure whose cover flap is swung open to expose a cassette player housed in the torso of the figure;

FIG. 3 schematically shows the cables running through the stuffed arms of the figure and connecting the output of the player to the headset earphones; and FIG. 4 illustrates in perspective another embodiment of the assembly.

DETAILED DESCRIPTION OF INVENTION

First Embodiment

Referring now to FIGS. 1 and 2 of the drawing, there is shown an assembly in accordance with the invention composed of a stuffed toy figure, generally identified by numeral 10, and an earphone headset 11 cooperating with the figure, the headset being worn by a child 12 carrying the figure.

The stuffed FIG. 10 has a humanoid or animal-like form and in this embodiment takes the form of a monkey having a head 13, a torso 14, a pair of arms 15 and 16 extending from the upper end of the torso and ending in hands 17 and 18, a pair of legs 19 and 20 ending in feet 21 and 22, and an elongated tail 23.

All components of the monkey-like figure are encased in a soft covering formed of woven or knit fabric or other plush material having a soft nap or pile. Each of those components is filled with a compressible stuffing such as cotton batting or flexible foam plastic material, such as polyurethane. Thus the stuffed figure is pleasant for a child to hold, squeeze and hug.

Housed in a compartment 24 in the front side of torso 14 is an audio tape cassette player 25, the compartment being open at the covering of the torso which is provided with a closable cover flap 26. In practice the cover flap is provided with a VELCRO fastener or similar means which make it possible to readily open the flap to obtain access to the player and to then close the flap to seal the compartment.

The player 26 which is of a battery-operated, portable-type, is adapted to reproduce the audio recording of the cassette placed therein. The choice of the recording, whether musical or otherwise, is made by the child who can insert in the player any cassette recording that he wishes to listen to through headset 11.

Headset 11 is provided with a yoke that is seated on the head and supports at its opposite extremitis left and right earphones 27 and 28. These earphones are connected by cables 29 and 30 that respectively run through the stuffing in the arm 15 and hand 17, and arm 16 and hand 18 to the output 31 of the cassette player 25 which in practice may be a stereo player.

The length of the portion of cables 29 and 30 extending from the ends of hands 17 and 18 to the earphones 27 and 29 to which the cables are connected is short. As a consequence of this arrangement, when the figure is carried by child 12 wearing headset 11 so that the figure lies against the torso of the child, the arms of the figure are then raised and the hands rest against the shoulders of the child, as shown in FIG. 1. The legs 19 and 20 of the figure then straddle the waist of the child, so that the figure appears to be embracing the child.

It is not necessary for the child carrying the figure to hold it with his hands, for the figure is suspended by its arms from the headset worn on the head of the child, and the figure dangles from the headset. It is desirable, therefore, that the cables have sufficient tensile strength to support the dangling figure. As shown in FIG. 2, the hands 17 and 18 of the figure have flat palms so that they can rest neatly on the shoulders of the child.

The cassette player 25 may be any commercially available compact player and in practice it may be of the microcassette type, so that the compartment in the torso to accommodate the player may be of a small size. And the headset may also be any standard, low-cost commercially-available headset. In practice, the cables connected to the earphones may be provided with plugs which go into earphone sockets, so that the headset may be detached from the figure.

Second Embodiment

The stuffed toy figure of the assembly may be in any fanciful animal-like or humanoid form, or the figure may have the shape of an established comic-strip or other character familiar to the child, such as an animal-like figure which plays a role in the Sesame Street TV program. In that event, the cassettes which are put in the cassette player preferably carry recordings which are related to the character as in my above-identified co-pending patent application.

In the assembly shown in FIG. 4, the stuffed toy figure 32, which has arm and leg appendages extending from the torso of the figure, has the form of a character, familiar to the child 33 carrying the figure and wearing a headset 34.

The assembly shown in this figure works in essentially the same way as the assembly shown in FIGS. 1 to 3, except that in this instance, the child is listening to recordings reproduced by player 25 housed in the torso of the figure which are related to the established character which the figure resembles. Thus if the figure is Donald Duck, the recording will carry the distinctive speaking voice of this character.

While there have been shown and disclosed preferred embodiments of the invention, it will be appreciated that many changes may be made therein without departing from the spirit of the invention. Thus instead of a cassette player, use may be made of a CD (Compact Disc) player.

I claim:

1. A toy figure and headset assembly comprising:

A. a stuffed toy figure having a stuffed torso and a pair of stuffed arms extending from the torso and ending in hands;

B. a portable audio player housed in the torso having a recording therein and an output which yields the signals of the recording reproduced by the player;

C. a headset wearable by a child carrying the figure and provided with left and right earphones; and D. a pair of cables extending from the output of the player housed in the torso through the respective arms and hands to the left and right earphones to convey the signal thereto, the cables acting to dangle the figure from the headset and to allow raising of the arms so as to rest the hands on the shoulder of a child.

2. An assembly as set forth in claim 1 in which the player includes an audio tape cassette carrying said recording.

3. An assembly as set forth in claim 1, in which the figure further includes a pair of stuffed legs that when the arms are raised, the legs may then straddle the waist of the child.

4. An assembly as set forth in claim 1, in which the figure is that of a monkey.

5. An assembly as set forth in claim 4, in which the figure further includes an elongated tail.

6. An assembly as set forth in claim 1, in which the figure is formed by a plush covering enclosing stuffing.

7. An assembly as set forth in claim 6, in which the compartment for the player is open at the covering of the torso, said covering being provided with a closable flap providing access to the compartment.

8. An assembly as set forth in claim 1, in which the figure resembles an established character, and the recording is related to this character.

* * * * *